United States Patent [19]

Gaylor

[11] Patent Number: 4,861,032

[45] Date of Patent: Aug. 29, 1989

[54] RANDOM NUMBER SELECTOR

[75] Inventor: Eli Gaylor, North Vancouver, Canada

[73] Assignee: The Winners' Choice Selector Inc., Vancouver, Canada

[21] Appl. No.: 266,336

[22] Filed: Nov. 1, 1988

Related U.S. Application Data

[63] Continuation of Ser. No. 15,041, Feb. 17, 1987, abandoned.

[51] Int. Cl.[4] ..... A63F 9/00

[52] U.S. Cl. ..... 273/144 B

[58] Field of Search ..... 273/144

[56] References Cited

U.S. PATENT DOCUMENTS

| | | | |
|---|---|---|---|
| 143,599 | 10/1873 | Twamly | 273/144 B |
| 2,091,883 | 8/1937 | Rochwarg | 273/144 R X |
| 2,385,980 | 10/1945 | Fostos | 273/144 A X |
| 4,364,567 | 12/1982 | Goott | 273/144 B X |
| 4,508,346 | 4/1985 | Salvucci | 273/144 B |
| 4,583,736 | 4/1986 | Lorraine | 273/144 B |

FOREIGN PATENT DOCUMENTS

| | | | |
|---|---|---|---|
| 552168 | 1/1984 | Canada | 273/144 B |
| 84/00115 | 1/1984 | World Int. Prop. O. | 273/144 B |

*Primary Examiner*—Paul E. Shapiro

[57] ABSTRACT

An apparatus and method for selecting random numbers. A stream of air provided from a fan beneath the chamber propels balls through a cylindrical display arrangement and back into the chamber. A first tube section extends from the chamber and is connected to a second display section which is partially transparent, perforated and extends generally parallel to the top surface of the chamber. A third tube section extends from the first tube section and returns to the chamber. The balls are retained in the generally parallel tube section by a retainer which, when released, allows the balls to be carried back into the chamber.

7 Claims, 2 Drawing Sheets

RANDOM NUMBER SELECTOR

This is a continuation of co-pending application Ser. No. 07/015,041, abandoned filed on Feb. 17, 1987.

This invention relates to a lottery number selection apparatus and, more particularly, to a lottery number selection apparatus which utilizes airflow to select the balls randomly and display them to a user.

BACKGROUND TO THE INVENTION

U.S. Pat. No. 4,508,346 to Salvucci entitled RANDOM NUMBER SELECTION METHOD AND APPARATUS utilizes airflow to select and entrain a desired number of balls in a transparent tube extending vertically from a mixing chamber. After the designated number of balls are selected, a mechanical finger is utilized to entrap the balls in the vertical tube for a determinate period of time until the identity of the balls entrapped is obtained. The finger is then released and the balls fall back into the mixing chamber where the selection process can be again commenced and repeated.

While the Salvucci device is useful, various disadvantages are present in the apparatus. One such disadvantage is that the apparatus is intended to be placed at a number of locations where members of the general public are present. The vertically oriented transparent tube is susceptible to damage or misalignment because of its location as well as vandalism because of its exposed and vulnerable configuration. A further problem with the vertical configuration disclosed by Salvucci relates to the quantity of the airflow required to properly entrap the required number of balls. The vertical tube requires a higher rate of airflow and consequently more energy than may be required with a different design which makes the machine vulnerable to poor operation in certain environments.

According to one aspect of the invention, there is disclosed a lottery number selection apparatus comprising a mixing chamber, a tube having a pluarity of cylindrical sections, one of said cylindrical sections being a display section, said tube having an inlet and an outlet end, each of said inlet and outlet ends being open in said mixing chamber, a cover for said mixing chamber surrounding at least a portion of said tube, air supply means to provide air to said chamber through an aperture, the first of said plurality of cylindrical sections including said inlet end located substantially coaxial with and above said aperture and said display section being operably connected with said first section and extending in a direction generally parallel with the uppermost portion of said cover of said mixing chamber.

SUMMARY OF THE INVENTION

According to a further aspect of the invention, there is disclosed a method of displaying a predetermined number of balls bearing incidia in a cylindrical display tube comprising the steps of supplying an airstream of a chamber from an aperture, blowing balls with said airstream into a first cylindrical section of said display tube, the inlet of said first section being located substantially adjacent to and directly above said aperture, allowing said balls to move from said first section to a second cylindrical display section extending adjacent to and parallel with the outside profile of said chamber, retaining a number of said balls in said second display section for a predetermined period of time, displaying said indicia of said balls through said second display section and releasing a retaining means to allow said balls to return to said chamber.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
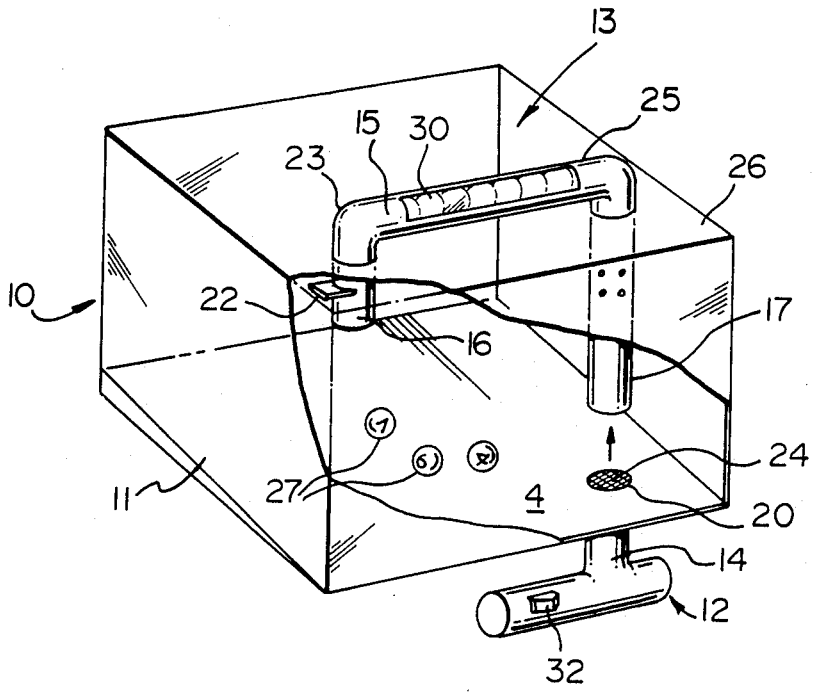
FIG. 1 is an isometric view of one embodiment of the present invention illustrating the display tube outside the cover.

Referring now to the drawings, the lottery selection apparatus is illustrated generally at 10. It comprises a generally rectangular mixing chamber 11, an air supply in the form of fan or blower 12 connected below the chamber 11, a plurality of balls generally shown at 27 in the chamber 11, each of the balls 27 bearing an indicia or number, and a display service or tube generally shown at 13 which extends from and returns to the chamber 11.

The fan 12 is connected to an input duct tube 14 which enters the chamber 11 from the fan 12 at the inlet aperture 20 of the chamber 11. The inlet aperture 20 is covered by a grate 24 to prevent balls entering the inlet duct tube 14. The tube 13 commences at a position immediately over the inlet aperture 20 and a first section 17 extends upwardly from the chamber 11 and is connected to the cover 26 of the chamber 11. The tube 13 has a second section 25 which extends from the first section 17 in a direction generally parallel and adjacent to the outside profile of the cover 26. The second section 25 of the tube 13 has a transparent window 30 which allows the balls 27 to be seen as they pass through and are retained in the tube 13. The second section 25 extends to an elbow 23 which leads from the second section 15 into third section 16. Third section 16 extends generally vertically downwards through cover 26 and into chamber 11 where it terminates.

Figure 4:
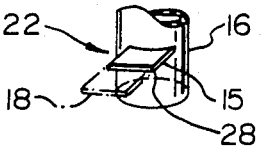
FIG. 4 is an isometric view of the retaining device of FIG. 1.

A retaining device 22 is positioned in the third section 16. The retaining device 22, more clearly seen in FIG. 4, is permanently attached to the third section 16 and has a tongue 28 movable between a first position 15 where the flow of balls through the tube 13 is blocked and a second position 18 where the flow of balls through the tube 13 can take place with no interference from the tongue 28 when the tongue 28 is released from its position blocking the flow. The retaining device 22 is operated by a solenoid (not shown).

A plurality of perforations in the second section 25 allows the escape of air from the tube 13.

OPERATION

In operation, the fan 12 is energized and air from the fan 12 travels through the tube 14 extending from the fan 12 to the chamber 11. The bottom of the chamber 11 is generally sloped so as to allow movement of the plurality of balls downward to the air inlet aperture 20 where they will be exposed to the airstream from the fan 12. The inlet aperture grate 24 prevents the balls from falling into tube 14 but allows the airstream to flow freely from the fan 12 into the mixing chamber 11. The air flow blows the balls 27 upwardly as they approach the inlet aperture 20 and some will be entrained singularly into the inlet of the first section 17 of the tube 13. A ball so entrained will be conveyed through the first section 17, the second section 25 and the third section 16 until it reaches the retaining device 22 where it will be held when the retaining device is positioned to block the third section 16. While the first ball is so retained, air flows outwardly from the perforations in the second section 25. Thereafter, further balls pipe up behind the first ball until the tube is full and a certain number of indicia are visible to the observer through the transparent window 30 on the second section 25. The identity of the balls held in the display tube 13 are then taken by the operator from the indicia written on the balls according to the sequence in which the balls entered the tube. After the identity of the balls is taken, the retaining device 22 is disengaged which allows the balls to return to the chamber 11 through the outlet of the third section 16.

When the retaining device 22 is disengaged, of course, the balls 27 entrained in tube 13 will continue their movement through the tube 13 and back into the mixing chamber 11 resulting in continuous movement of balls through the tube 25.

Figure 2:
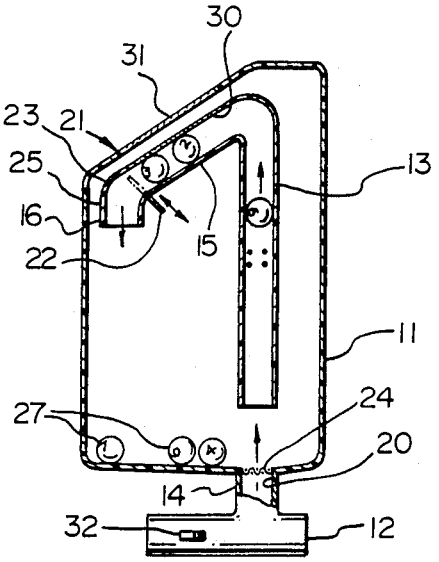
FIG. 2 is a side cutaway view of a second embodiment of the apparatus of FIG. 1 illustrating the display tube inside the cover.

A further embodiment of the invention is illustrated in FIG. 2. In this embodiment, the chamber 11 is not rectangularly shaped as is the chamber 11 of FIG. 1 nor is the second section 25 of the tube 13 outside the chamber 11. Rather, the tube 13 is wholly within the chamber 11 which has a sloping upper surface 21. The tube 13 again extends substantially parallel and adjacent to the outside profile of the cover 11 and this embodiment is attractive when it is desirable to increase security by removing any external projections of the tube 13 from the chamber 11.

Also in this embodiment, the transparent window of the second section of the tube 13 is complimented by a transparent panel 31 in the cover 11 adjacent to and substantially conterminous with the transparent window 30 of the second section of the tube 13. Furthermore, the embodiment illustrated in FIG. 2 has its retaining device 22 located at the end of the second section 25 and not in the third section 16 as there is no need to use a return or third section because of the downwardly sloping second section 25.

Figure 3:
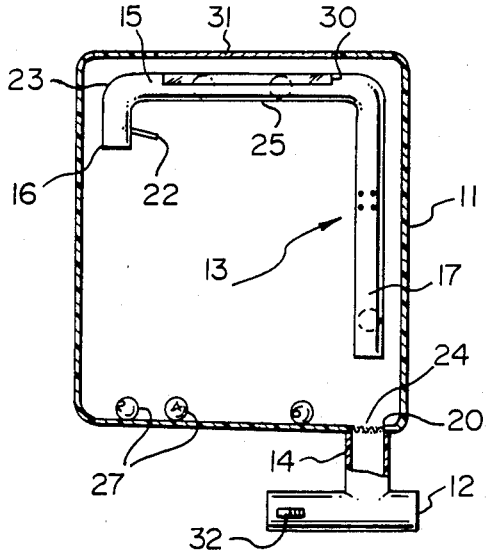
FIG. 3 is a front cutaway view similar to FIG. 2 illustrating a third embodiment of the apparatus according to the invention.

Yet a further embodiment of the invention is illustrated in FIG. 3. This embodiment is similar to the embodiment of FIG. 1 with the exception that the tube 13 is wholly within the mixing chamber 11 to reduce the possibility for vandalism by removing any external parts of the tube 13 such as illustrated in FIG. 1. In this embodiment, a transparent panel 31 is provided in the chamber 11 so that the balls 27 displayed in the second section 25 of the tube 13 are visible through the transparent window 30 and panel 31 to the user.

Modifications may readily be made to the apparatus described. For example, while the fan or blower 12 may be turned on only when used as by a switch 32, it may also be running continuously so that the balls 27 are continuously moving in the chamber 11 and through the tube 13. Further, the functions of the retaining device 22 may be automatic as, for example, when the apparatus is used to select lottery numbers. In this event, a coin or ticket (not shown) is inserted in the apparatus and will automatically activate the retaining device to stop the flow of balls 27 through the tube 13 for a period of time sufficient to allow the balls 27 to be retained and displayed in the second section 25. Thereafter, the retaining device 22 can be automatically opened by a timing device (not shown) which will then release the balls 27 and allow them to continue flowing through the tube 13. Alternatively, of course, the retaining device 22 may be manually operable as from a button (not shown) which the operator may press either at will or during a predetermined time period.

In addition, the transparent panel 31 in the cover 11 may be replaced with a magnifying panel which may allow the display tube to run at an angle to the outside profile of the cover 11. Such a magnifying prism would, of course, allow the balls to be positioned at different positions within the display tube 13, so long as the identity of the balls was readily observable by the user.

Various other modifications beside those specifically described will readily occur to those skilled in the art and the specific embodiments described should be taken as illustrative only and not as limiting the scope of the invention as construed in accordance with the accompanying claims.

I claim:

1. A lottery number selection apparatus comprising a mixing chamber, a tube mounted wholly within said chamber, said tube having a plurality of cylindrical sections, one of said cylindrical sections being a display section, said tube having an inlet and an outlet end, each of said inlet and outlet ends being in open in said mixing chamber, a retaining means to retain a plurality of balls in said tube, a cover for said mixing chamber surrounding said tube, air supply means to provide air to said chamber through an aperture, the first of said plurality of cylindrical sections including said inlet end located substantially coaxial with, directly adjacent to and above said aperture, said display section being operably connected with said first section and extending in a direction generally parallel with the uppermost portion of said cover of said mixing chamber, said display section being visible external of said chamber.

2. A lottery number selection apparatus as in claim 1 wherein said display section and said cover include a transparent window.

3. A lottery number selection apparatus as in claim 2 wherein said retaining means is a releasable ball retainig device mounted in said second section for retaining said balls in and releasing said balls from said second section.

4. A lottery number selection apparatus as in claim 3 wherein said tube includes a further cylindrical section, said further section including said outlet end open in said chamber.

5. A lottery number selection apparatus as in claim 4 wherein said display section of said tube and said outside profile of said cover are substantially horizontal.

6. A method of displaying a plurality of balls bearing indicia in a cylindrical display tube comprising the steps of supplying an air stream to a chamber from an aperture, continuously blowing each of said plurality of balls with said airstream until each of said balls enters said cylindrical display tube, said display tube extending adjacent to and parallel with the outside profile of said chamber, retaining said plurality of balls in said cylindrical display tube for a predetermined period of time, and releasing a retaining means to allow said plurality of balls to return to said chamber.

7. A method as in claim 6 wherein said balls are displayed outside said chamber.

* * * * *